US006082453A

United States Patent [19]

Bakke

[11] Patent Number: 6,082,453

[45] Date of Patent: Jul. 4, 2000

[54] ORIENTATION DEVICE, PARTICULARLY FOR DRILLING TOOL OR A WELL EQUIPMENT

[75] Inventor: Stig Bakke, Ålgård, Norway

[73] Assignee: Bakke Oil Tools AS, Algard, Norway

[21] Appl. No.: 09/125,504

[22] PCT Filed: Feb. 5, 1997

[86] PCT No.: PCT/NO97/00034

§ 371 Date: Aug. 12, 1998

§ 102(e) Date: Aug. 12, 1998

[87] PCT Pub. No.: WO97/30262

PCT Pub. Date: Aug. 21, 1997

[30] Foreign Application Priority Data

Feb. 19, 1996 [NO] Norway ..... 960641

[51] Int. Cl.[7] ..... E21B 23/00

[52] U.S. Cl. ..... 166/240; 166/242.7; 175/73; 175/106; 175/195; 175/319; 175/323

[58] Field of Search ..... 166/240, 241.1, 166/241.3, 241.4, 242.1, 242.6, 242.7; 175/73, 106, 113, 121, 195, 319, 323

[56] References Cited

U.S. PATENT DOCUMENTS

| | | | |
|---|---|---|---|
| 3,405,771 | 10/1968 | Carr et al. | 175/73 |
| 4,286,676 | 9/1981 | Nguyen et al. | 175/74 |
| 4,596,294 | 6/1986 | Russell | 175/74 |
| 5,305,837 | 4/1994 | Johns et al. | 175/61 |
| 5,322,136 | 6/1994 | Bui et al. | 175/65 |

*Primary Examiner*—Roger Schoeppel
*Attorney, Agent, or Firm*—Head, Johnson and Kachigian

[57] ABSTRACT

An orientation device, particularly for drilling tools, of the kind comprising a first sleeve (1) and a concentrically surrounding second sleeve (2), where in an annulus between the sleeve (1) and the sleeve (2) is disposed an axially displaceable carrier, e.g., in the form of a wedge/key (5) or a rail (8, 9), adapted to slide in an inclined, preferably helical groove (3, 4) disposed in the sleeve (1) or in the sleeve (2), the groove's direction crossing the direction of the carrier's (5; 8, 9) rectilinear movement which, thus, is converted into a relative rotational movement between the sleeve (1) and the sleeve (2). The carrier (5; 8, 9) is adapted to slide in two inclined, preferably helical grooves (3, 4) disposed in the sleeve (1) and the sleeve (2), respectively, and crossing the direction of the carrier's (5; 8, 9) rectilinear movement from opposite side.

8 Claims, 7 Drawing Sheets

ORIENTATION DEVICE, PARTICULARLY FOR DRILLING TOOL OR A WELL EQUIPMENT

CROSS-REFERENCE TO RELATED APPLICATIONS

This application claims priority to PCT Application No. PCT/NO97/00034 filed Feb. 5, 1997 which claims priority from Norwegian Patent Application NO. 960641 filed Feb. 19, 1996.

The invention relates to an orientation device, particularly for a drilling tool or a well equipment in oil or gas wells, of the kind comprising a first sleeve and an axially displaceable carrier, e.g. in the form of a wedge or a rail adapted to slide in an inclined, preferably helical groove formed in first sleeve, the groove direction crossing the direction of the rectilinear movement of the carrier, said movement, thus, being converted into a rotational movement of first sleeve.

During the drilling of oil and gas wells, a bent transition piece is often used, in English designated "bent sub", between the bit and the drill string, in order to achieve a directional deviation between the axis of the drill string and the axis of the bit. Upon rotation of the bent transition piece or sub, the bit may be brought to point in the direction in which one desires to drill.

It has been found difficult to make the bit pointing in the desired direction through a rotation of the drill string and, when using coilable tubing, it is not possible to orientate the bit in that way. Therefore, it is usual to dispose a downhole orientation device which is guided and controlled from the surface, in order to rotate the bent transition piece or sub and to bring the bit to point in the desired direction.

There exists a plurality of various types of devices for this purpose. A common feature of these known devices is the conversion of a rectilinear movement into a rotational movement. This is appropriate because of the ease to convert the hydraulic force available through drill fluid into a controlled rectilinear movement by displacing a hydraulic piston.

U.S. Pat. No. 4,286,676 deals with a tool for use with directional drilling, wherein a carrier is adapted to slide in a groove, in order to create rotation of a sleeve.

Another usual way of converting a rectilinear movement into a rotational movement is to use some form of screw-nut combination, frequently disposed such that a carrier in the form of a wedge or a wedge-like means slides in a helical groove.

In order to convert a linear movement into a rotational movement by leans of a helical thread, the pitch of the helical thread must be so great that self-bloc ing or self-locking is avoided. The limit value of the pitch for self-blocking depends on the friction. In practice, it has been found that the requirement for torsional moment is the dimensioning factor in these cases. In order to obtain a sufficient torsional moment, the pitch of the helical thread must also be large.

However, a large pitch angle causes that the rectilinear movement needed in order to achieve a given rotational angle, becomes longer. Known orientation devices are unappropriately long, shorter constructional measures being desired.

The object of the invention is to provide an orientation device having a substantially shorter constructional length than prior art tools.

The object is achieved through features as defined in the following claims.

In the following, the invention is described by means of two exemplary embodiments, reference beign made to attached drawings, wherein:

BRIEF DESCRIPTION OF THE DRAWINGS

In FIG. 1, the reference numeral 1 denotes a first sleeve constituting the core of an orientation device. First sleeve 1 is surrounded by a concentrical, second sleeve 2. In the external face of first sleeve 1, a helical groove 3 is disposed. In the internal face of second sleeve 2, a helical groove 4 is disposed, the latter groove 4 having the same pitch angel as the groove 3, but extending in the opposite helical direction. First sleeve 1 and second sleeve 2 are orientated such that the grooves 3, 4 are crossing each other and, within the crossing area, a movable wedge 5 is placed adapted to slide in both grooves 3, 4. The wedge 5 is assigned an operating rod 6 which is connected to an actuator, not shown, and adapted to displace the wedge 5 along a straight line parallel to the axis of first sleeve 1 and second sleeve 2, such as marked by means of an arrow a in FIG. 2.

When the wedge 5 is displaced, first sleeve 1 rotates an angle which is dependent on the pitch angel of the groove 4. Second sleeve 2 rotates simultaneously a corresponding angel in the opposite direction. Thus, the angular change between first sleeve 1 and second sleeve 2 becomes twice as large as the rotational angel for each of them. FIG. 3 shows diagrammatically the two grooves 3 and 4 in three different positions corresponding to the wedge 5 occupying three different levels.

Figure 1:
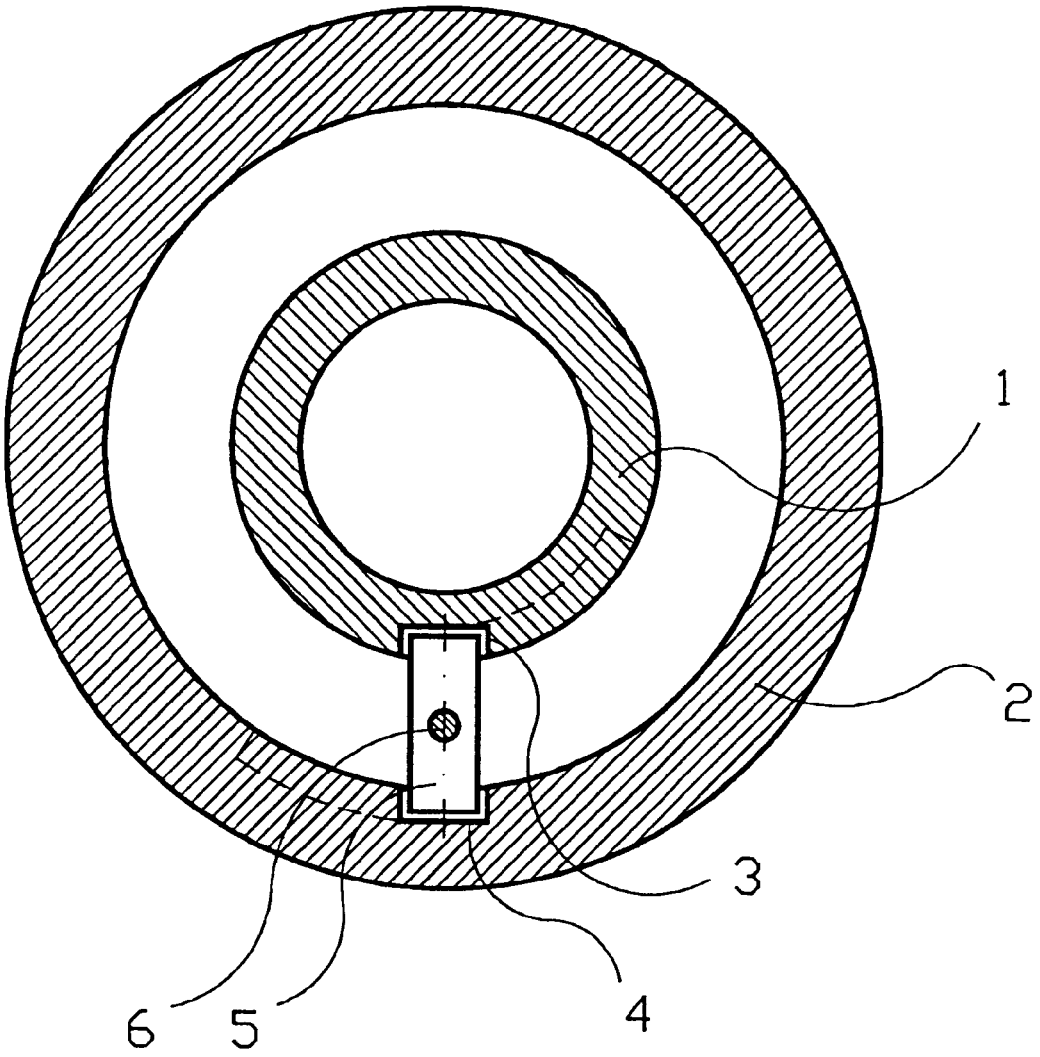
FIG. 1 shows a cross-section of a simplified orientation device.
Figure 2:
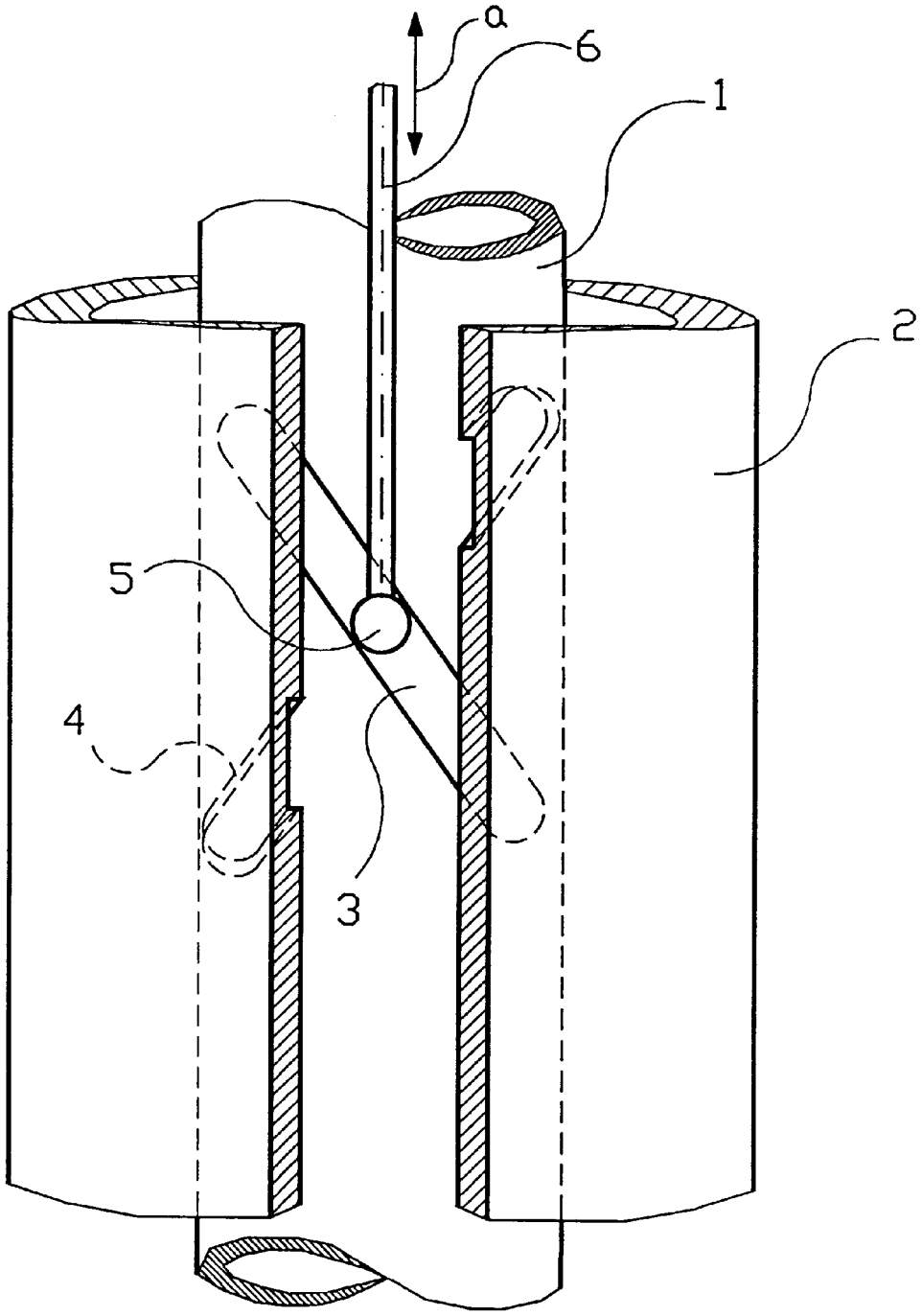
FIG. 2 shows, partly in section, partly in side elevational view, the same simplified orientation device as in FIG. 1.
Figure 3:
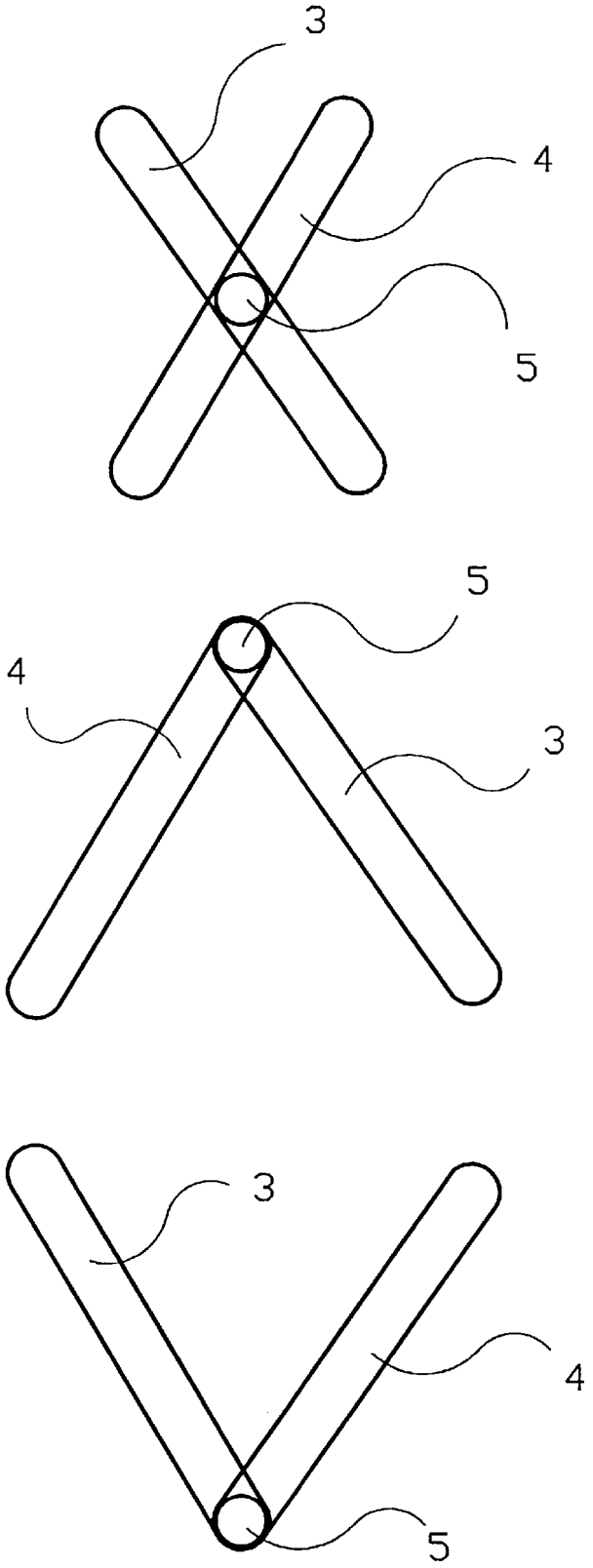
FIG. 3 shows a sketch of principle of the orientation device's turn-mechanism for three rotational positions.

By maintaining second sleeve 2 stationary, i.e. preventing it from rotating, and simultanelously disposing the operating rod 6 and the actuator, not shown, belonging thereto, rotatably about the common axis of first sleeve 1 and second sleeve 2, the entire angular change can pass to first sleeve 1. The wedge 5, the operating rod 6 and the actuator, not shown, will rotate an angel decided by the pitch angle of the groove 4 and how far the wedge 5 is displaced. Simultaneously, first sleeve 1 will be rotated in relation to the wedge 5 an angle determined by the pitch angle of the groove 3 and how far the wedge 5 is displaced. Thus, a twice as large rotational angle is achieved based on a given pitch of the helical grooves 3, 4 as wall as a given displacement of the wedge 5 as compared with known orientation devices. Thus, the same rotational angle as for known orientation devices can be obtained, using half the constructional length thereof in combination with the orientation device according to the invention.

Figure 4:
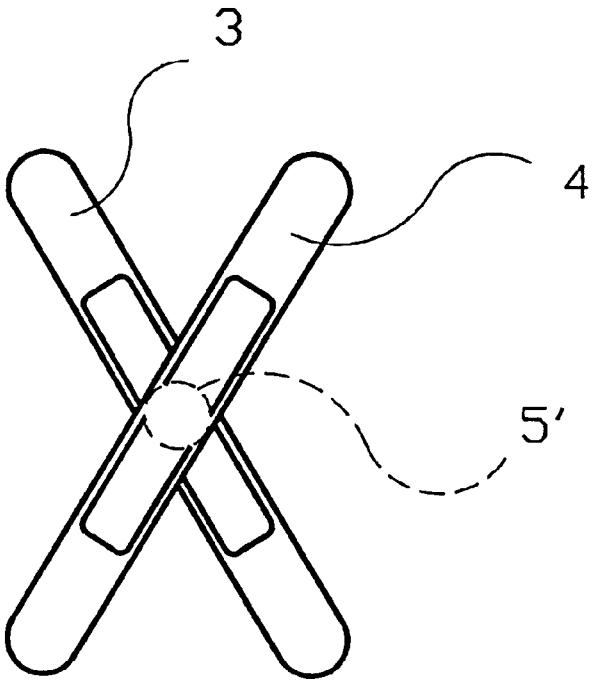
FIG. 4 shows in a side elevational view a sketch of principle of a wedge meshing with two crossing grooves.
Figure 5:
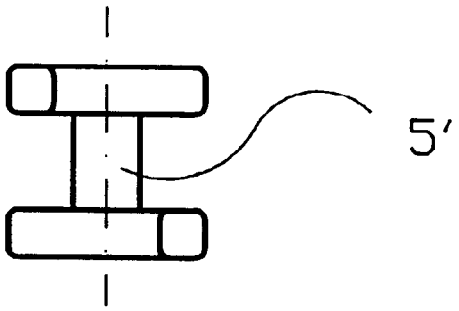
FIG. 5 shows in a top plan view the same wedge as in FIG. 4.

In order to avoid a too high point load in the contact face where the wedge 5 rests against the side face of the grooves 3, 4, the contact face can be increased by forming the wedge 5 with an elongate widening at each end, e.g. such as the wedge 5' in FIG. 4 and FIG. 5.

In order to increase the contact face between wedge 5 and groove 3, 4 further and simultaneously distribute loads on first sleeve 1 and second sleeve 2, more grooves may advantageously be disposed, parallel to the grooves 3, 4 in first and second sleeve 1, 2, respectively. Simultaneously, more wedges 5 assigned operating rods 6 must be disposed correspondingly.

DETAILED DESCRIPTION OF THE PREFERRED EMBODIMENT

Figure 6:
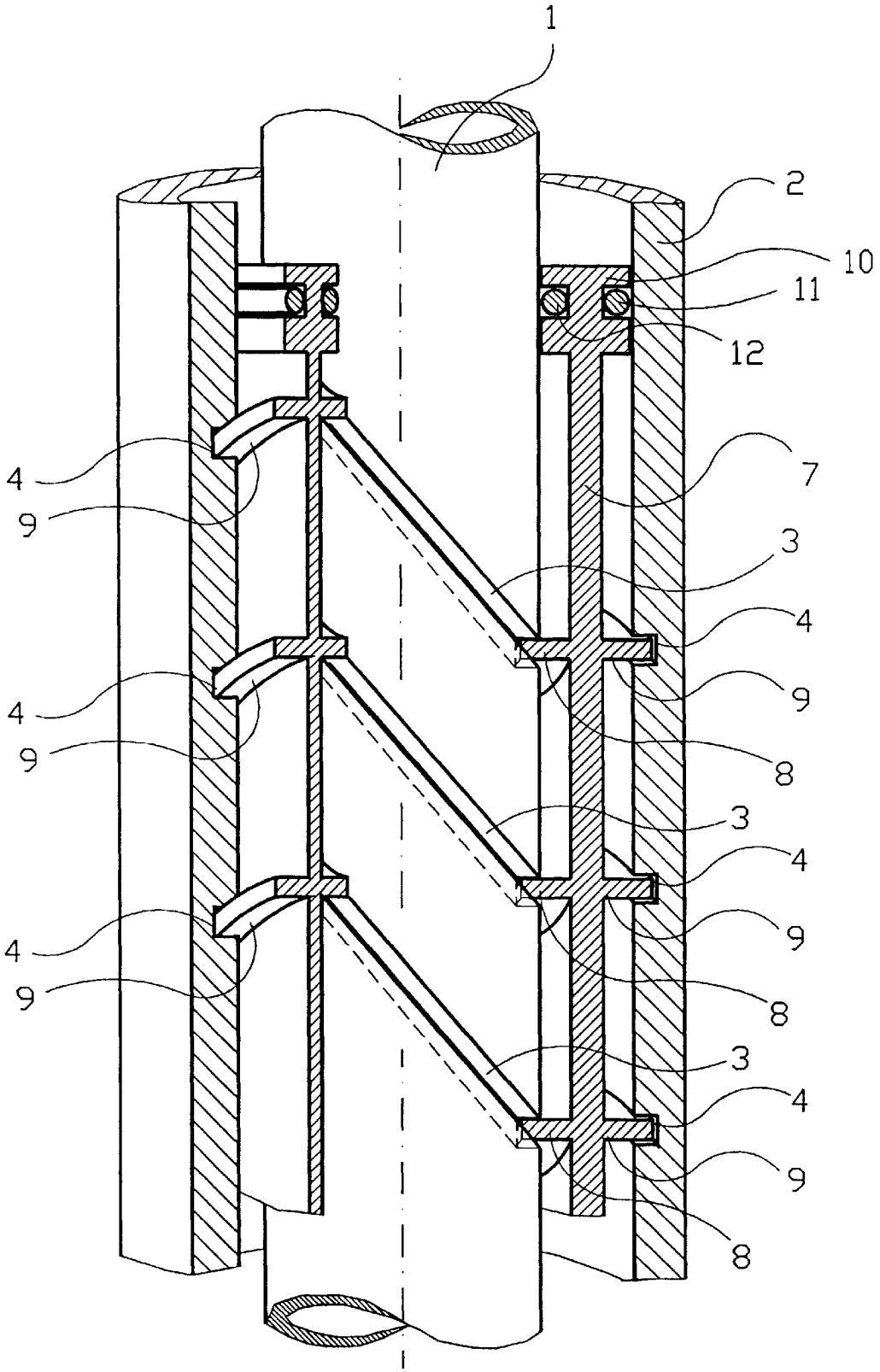
FIG. 6 shows in a side elevational view, partly in section, a turn-mechanism in an orientation device.

In a preferred embodiment of an orientation device, instead of the wedge 5, the wedge 5', possibly several wedges 5, 5' having operating rods 6 belonging thereto, a rotatable, third sleeve 7 has been disposed in the annulus between first sleeve 1 and second sleeve 2. The sleeve 7 is provided with several internal and external helical rails 8 and 9, respectively, parallel to and engaging into a plurality of grooves 3 and 4. Displacing third sleeve 7 axially, provides the same effect as already explained in connection with the wedge 5. If second sleeve 2 is kept stationary while third sleeve 7 is displaced, third sleeve 7 will simultaneously as it is displaced, rotate about the axis of the first sleeve 1 a certain angle given by the displacement of third sleeve 7 and the pitch angle of the grooves 4. First sleeve 1 will rotate through a larger angle detemined by third sleeve's 7 displacement and the pitch angle of the grooves 3, 4. If the grooves 3, 4 have the same pitch angle, first sleeve rotates twice as large an angel as third sleeve 7. Third sleeve 7 is assigned an annular piston 10 adapted to slide sealingly against first sleeve 1 and second sleeve 2 in the annulus between the sleeves 1, 2, the piston 10 being provided with packers 11, 12. The piston 10 may be formed as a continuation of third sleeve 7 and as a part thereof, see FIG. 6. Upon the supply of hydraulic pressurized fluid into the annulus, at one side or the other of the piston 10, the piston 10 and the third sleeve 7 may be displaced in the annulus, causing the rotation of the first sleeve 1 in the desired direction.

Figure 7:
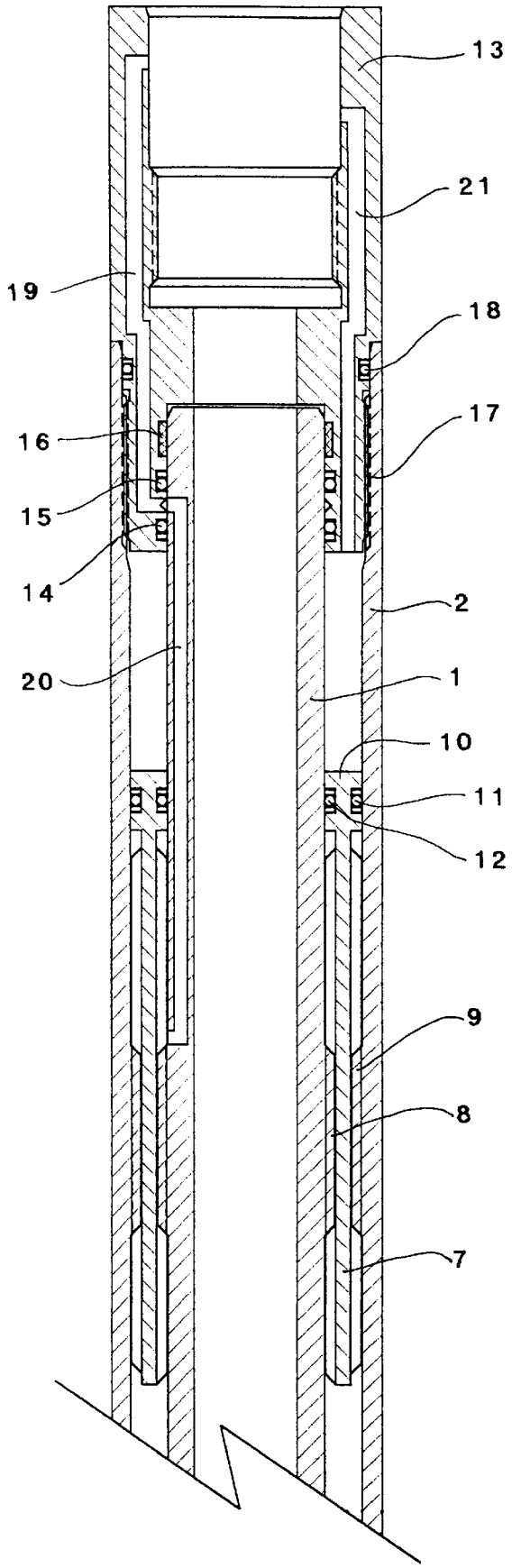
FIGS. 7 and 8 show in sectional views the upper and lower half, respectively, of an orientation device.
Figure 8:
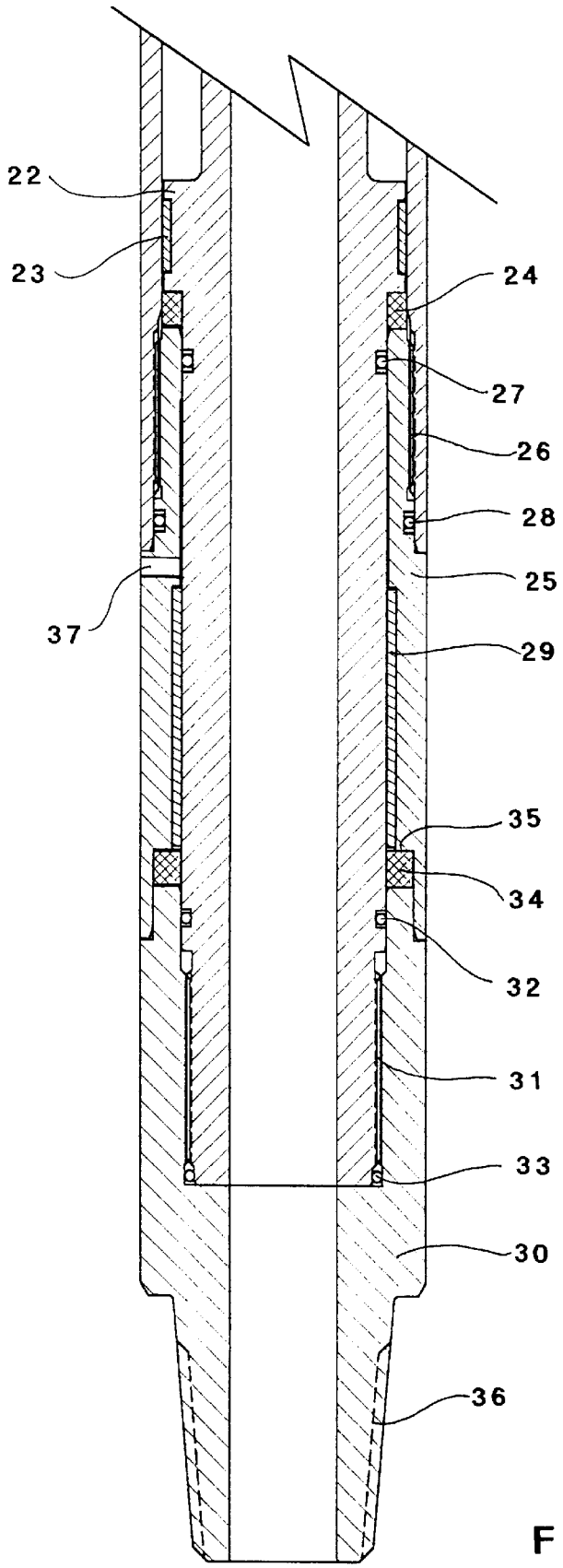

FIGS. 7 and 8 show in sectional view an assembly of upper and lower half, respectively, of an orientation device. As mentioned, first sleeve 1 constitutes the core of the orientation device and is adapted to conduct drill fluid through the orientation device. First sleeve 1 is surrounded by second sleeve 2 and, in the annulus between the sleeves 1 and 2, is placed an axially displaceable, third sleeve 7 having helical internal and external rails 8, 9, engaging into grooves 3, 4 in the outer face of first sleeve 1 and the inner face of second sleeve 2, respectively. When third sleeve 7 is displaced, the sleeves 1, 2 are rotated in relation to each other, such as previously described.

At the upper end, first sleeve 1 is rotatably and pressure-tightly mounted in an upper and piece 13, two annular packers 14, 15 and a radial bearing 16 being disposed in the contact face between first sleeve 1 and end piece 13. Second sleeve 2 is stationarily and pressure-tightly connected to the end piece 13 by means of threads 17 and a packer 18. A substantially axially directed channel 19 in the wall of the end piece 13 is adapted to communicate with a substantially axially directed channel 20 in the wall of first sleeve 1, both channels 19, 20 opening out between the packers 14 and 15. Further, the channel 20 opens out in the annulus between the sleeves 1, 2 below the piston 10, so that hydraulic pressurized fluid can be passed through the channels 19, 20 to beneath the piston 10, in order to push the piston 10 and, thus, third sleeve 7 upwardly. A substantially axially directed channel 21 in the wall of the end piece 13 opens out in the annulus between first sleeve 1 and second sleeve 2 above the piston 10, so that hydraulic pressurized fluid can be passed through the channel 21 to above the piston 10, in order to push the piston 10 and, thus., third sleeve 7 downwardly. As previously known, the end piece 13 is adapted to be connected to a drill pipe, not shown, typically a coilable tubing, so that the channels 19, 21 can be coupled to hoses for hydraulic pressurized fluid in the drill pipe.

The annulus within which the piston 10 and third sleeve 7 move, is uppermost defined by the end piece 13 and lowermost by an external annular portion 22 of first sleeve 1. The annular portion 22 is assigned a radial bearing 23 rotatably mounting first sleeve 1 within second sleeve 2. An axial bearing 24 within the annulus between the sleeves 1, 2 below the annular portion 22, rests against the end of a bearing sleeve 25 screwed into the lower end of second sleeve 2, forming a fixed continuation thereof, second sleeve 2 and bearing sleeve 25 being provided with threads 26. A downwardly directed axial force in first sleeve 1 is, thus, accommodated by the axial bearing 24, the bearing sleeve 25 and second sleeve 2. An annular packer 27 seals between first sleeve 1 and the bearing sleeve 25, and an annular packer 28 seals between the bearing sleeve 25 and second sleeve 2. A radial bearing 29 provides rotatable mounting of first sleeve 1 in the bearing sleeve 25. At the lower end thereof, first sleeve 1 is rigidly and pressure-tightly connected to a lower end piece 30 through threads 31 and packers 32, 33. Uppermost, the and piece 30 is provided with a graduation passed into the lower end of the bearing sleeve 25. An axial bearing 34 is placed between the upper edge of the end piece 30 and an internal shoulder 35 in the bearing sleeve 25. An upwardly directed axial force in first sleeve 1 is, thus, transferred from the end piece 30 to the bearing sleeve 25 and to second sleeve 2. As previously known, the lower part of the end piece 30 is provided with threads 36 for coupling thereto a drilling equipment or well equipment, not shown.

In the bearing sleeve 25, a radial threaded hole 37 is disposed, for attaching a grease nipple, not shown, allowing grease to be squeezed into the radial bearing 29 and the axial bearing 35. When the orientation device is in use, the hole 37 is sealed by means of a threaded plug, not shown.

In second sleeve 2, adjacent the radial bearing 23 and the axial bearing 24, a threaded hole has been disposed, in order to vent the annulus in which the piston 10 and third sleeve 7 are situated. When the orientation device is in use, said hole is sealed by a of a threaded plug.

What is claimed is:

1. An orientation device for drilling tools or well equipment in oil or gas wells, which device comprises:

a first sleeve and an axially displaceable carrier adapted to slide in an inclined groove formed in said first sleeve, the direction of said groove crossing the direction of rectilinear movement of said carrier, the rectilinear movement being converted into rotational movement of said first sleeve; and a second sleeve concentric with said first sleeve, said second sleeve formed with a crossing groove into which the carrier also engages slidingly.

2. An orientation device as set forth in claim 1 wherein said carrier is a wedge or key.

3. An orientation device as set forth in claim 1 wherein said carrier is a rail.

4. An orientation device as set forth in claim 1 wherein said carrier is moved by an operating rod.

5. An orientation device as set forth in claim 1 wherein said first sleeve and said second sleeve inclined grooves are helical.

6. An orientation device as set forth in claim 5 wherein said first sleeve helical groove extends in an opposite helical direction from said second sleeve helical groove.

7. An orientation device as set forth in claim 1 wherein said carrier rotates, both said first and said second sleeve.

8. An orientation device as set forth in claim 1 including a third sleeve disposed between said first and second sleeve and coaxial with said first and second sleeve.

* * * * *